US005584153A

United States Patent [19]

Nunley et al.

[11] Patent Number: 5,584,153

[45] Date of Patent: Dec. 17, 1996

[54] COMPOSITE ROOF SYSTEM WITH AN IMPROVED ANCHORING MECHANISM

[75] Inventors: C. Lynn Nunley, Dallas; Joe W. Tomaselli, Plano, both of Tex.

[73] Assignee: Loadmaster Systems, Inc., Duluth, Ga.

[21] Appl. No.: 219,107

[22] Filed: Mar. 29, 1994

[51] Int. Cl.[6] ..... E04B 7/00; E04B 1/74

[52] U.S. Cl. ..... 52/410; 52/309.2; 52/409; 52/545; 52/549; 52/551; 52/552; 52/787.1; 52/787.11; 52/783.19

[58] Field of Search ..... 52/410, 309.2, 52/309.7, 408, 409, 545, 549, 551, 552, 787, 368, 787.1, 787.11, 783.19, 784.15, 528

[56] References Cited

U.S. PATENT DOCUMENTS

| | | | |
|---|---|---|---|
| 1,939,732 | 12/1933 | Stresau . | |
| 1,959,766 | 5/1934 | Sayler | 52/795 X |
| 2,249,590 | 7/1941 | Allen | 52/404.1 X |
| 2,703,835 | 3/1955 | Douglas . | |
| 3,290,845 | 12/1966 | Snyder | 52/545 X |
| 3,300,933 | 1/1967 | Donahue | 52/368 |
| 3,362,119 | 1/1968 | Murphy . | |
| 3,401,494 | 9/1968 | Anderson | 52/309.2 |
| 3,466,827 | 9/1969 | Clem . | |
| 3,483,664 | 12/1969 | Funk et al. . | |
| 3,488,904 | 1/1970 | Schneller et al. | 52/787 X |
| 3,545,152 | 12/1970 | Knohl | 52/367 |
| 3,763,614 | 10/1973 | Hyde et al. . | |
| 3,922,828 | 12/1975 | Patton | 52/368 |
| 3,935,021 | 1/1976 | Greve et al. . | |
| 3,965,633 | 6/1976 | Carroll | 52/410 X |
| 3,971,184 | 7/1976 | Van Wagoner . | |
| 3,979,867 | 9/1976 | Sowinski | 52/309.2 X |
| 3,993,822 | 11/1976 | Knauf et al. . | |
| 4,047,355 | 9/1977 | Knorr . | |
| 4,063,395 | 12/1977 | Stewart et al. . | |
| 4,071,993 | 2/1978 | Stewart et al. . | |
| 4,081,938 | 4/1978 | Bertacchi et al. | 52/795 X |
| 4,114,338 | 9/1978 | Beck | 52/551 X |
| 4,122,644 | 10/1978 | Woodruff | 52/787.11 |
| 4,232,612 | 11/1980 | Winsor . | |
| 4,233,468 | 11/1980 | Northup, Jr. | 52/410 X |
| 4,269,012 | 5/1981 | Mattingly et al. | 52/410 X |
| 4,324,082 | 3/1982 | Rutkowski et al. . | |
| 4,333,280 | 6/1982 | Morton . | |
| 4,333,290 | 6/1982 | Koberstein | 52/309.2 X |
| 4,333,292 | 6/1982 | Musgrave | 52/410 X |
| 4,348,846 | 9/1982 | Bellem | 52/410 |
| 4,364,212 | 12/1982 | Pearson et al. . | |
| 4,441,295 | 4/1984 | Kelly . | |
| 4,450,663 | 5/1984 | Watkins . | |
| 4,480,416 | 11/1984 | Judkins et al. | 52/376 |
| 4,558,550 | 12/1985 | Marchais et al. . | |
| 4,601,151 | 7/1986 | Nunley et al. . | |
| 4,647,496 | 3/1987 | Lehnert et al. . | |
| 4,651,489 | 3/1987 | Hodges et al. | 52/409 |
| 4,707,961 | 11/1987 | Nunley et al. . | |
| 4,736,561 | 4/1988 | Lehr et al. . | |
| 4,783,942 | 11/1988 | Nunley et al. . | |
| 5,001,881 | 3/1991 | Boyd | 52/545 |
| 5,088,259 | 2/1992 | Myers | 52/783.19 X |
| 5,095,673 | 3/1992 | Ward | 52/410 X |

FOREIGN PATENT DOCUMENTS

| | | |
|---|---|---|
| 993779 | 7/1976 | Canada . |

*Primary Examiner*—Wynn E. Wood
*Assistant Examiner*—Laura A. Saladino
*Attorney, Agent, or Firm*—Crutsinger & Booth

[57] ABSTRACT

The roof system is formed of a corrugated sheet of material anchored to a roof beam, a mineral board anchored to the peaks of the corrugated sheet having a moisture barrier, at least one layer of insulating material interposed between the mineral board and the corrugated sheet, and standing seam metal roof panels anchored to the mineral board. A staggered anchoring system is provided which eliminates thermal shorts from the outside of the roof to the inside roof beams.

15 Claims, 2 Drawing Sheets

COMPOSITE ROOF SYSTEM WITH AN IMPROVED ANCHORING MECHANISM

TECHNICAL FIELD

The present invention relates to improvements in an anchoring mechanism for attaching standing seam metal roofing panels over a composite roof.

BACKGROUND OF INVENTION

Composite roof deck assemblies are disclosed in U.S. Pat. No. 4,601,151; U.S. Pat. No. 4,736,561; U.S. Pat. No. 4,707,961 and U.S. Pat. No. 4,783,942.

U.S. Pat. No. 4,601,151 discloses a roof system comprising a sheet of corrugated material having ridges and a rigid substrate, such as a mineral board, fastened to the upper ridges of the corrugated sheet. The corrugated sheet is welded to roof purlins. The mineral board, on the other hand, is fastened to the corrugations of the corrugated sheet by threaded fasteners which extend through the mineral board and through the ridges to form a truss -like structure that spans between the roof purlins.

When an insulated roof is desired, insulation is interposed between the mineral board and the corrugated sheet. As the insulation thickness increases the length of the threaded fasteners increases, creating potential rotation and bending problems for the fasteners. As a result the thickness of the insulation is limited by the threaded fastener length. Additionally, since fasteners typically extend all the way through the roofing layers from the exterior of the roof to the interior supporting structure of the roof, thermal shorts are created between the exterior of the roof and the interior of the roof, which is undesirable in extremely cold climates.

A roof system with improved insulation is desired which will eliminate the thermal shorts by providing a staggered anchoring system and, subsequently, shorter threaded fastener lengths thereby alleviating potential rotation and bending problems.

SUMMARY OF INVENTION

A roof deck system constructed in accordance with the teachings of U.S. Pat. No. 4,601,151 is secured to supporting roof beams. A corrugated sheet is positioned such that ridges and valleys on the corrugated material extend transversely between spaced roof beams.

The roof system includes a rigid substrate board, such as mineral board or the like, anchored to the peaks of the corrugated sheet with a moisture barrier provided over the rigid substrate. Insulating material may be interposed between the mineral board and the corrugated sheet to provide an insulating layer. An exterior roofing layer such as a standing seam metal roof is anchored through the mineral board to the improved anchoring system thereby creating a vertically oriented staggered anchorage system which eliminates thermal shorts from the outside of the roof to the underside of the roof deck inside the conditioned structure.

The anchoring system comprises a fastener such as a bolt, threaded screw or rod, extending through the rigid board and an elongated fastener retention wind-uplift strip which is positioned on the underside of the rigid board to engage the threaded fastener. Rigid substrates are not typically classified as loading bearing members and have low punching shear capacities and, consequently, are not normally suitable for anchoring mechanisms which experience any significant loading. To overcome the mineral board's low punching shear capacity, the elongated retention strip has a large bearing surface and is sized to increase the shear area of the rigid mineral board sufficiently to overcome the mineral board's structural limitations. The retention strip is also sized to increase the anchorage target surface area to ease installation. Additionally, retention strip is preferably a channel shaped member having a web and a pair of flanges which extend into an insulation layer to fix the portion of the retention strip under the mineral board, thereby reducing the tendency of the strip to shift after initial placement. Alternatively, the retention strip can be provided with an adhesive back facing the mineral board to alleviate shifting tendencies of the strip.

The anchor mechanism disclosed greatly improves the thermal insulation properties of the roof by eliminating thermal shorts normally associated with roof anchoring systems. Additionally, the anchoring mechanism allows for reduced fastener lengths and, therefore, reduces the rotation and bending problems associated with longer fasteners.

DESCRIPTION OF THE DRAWINGS

Drawings of a preferred embodiment of the invention are annexed hereto so that the invention may be better and more fully understood, in which.

Other objects and advantages of the invention will become apparent upon reading the following detailed description and upon reference to the drawings, in which like reference characters are used throughout the drawings to designate like parts.

DESCRIPTION OF A PREFERRED EMBODIMENT

Figure 1:
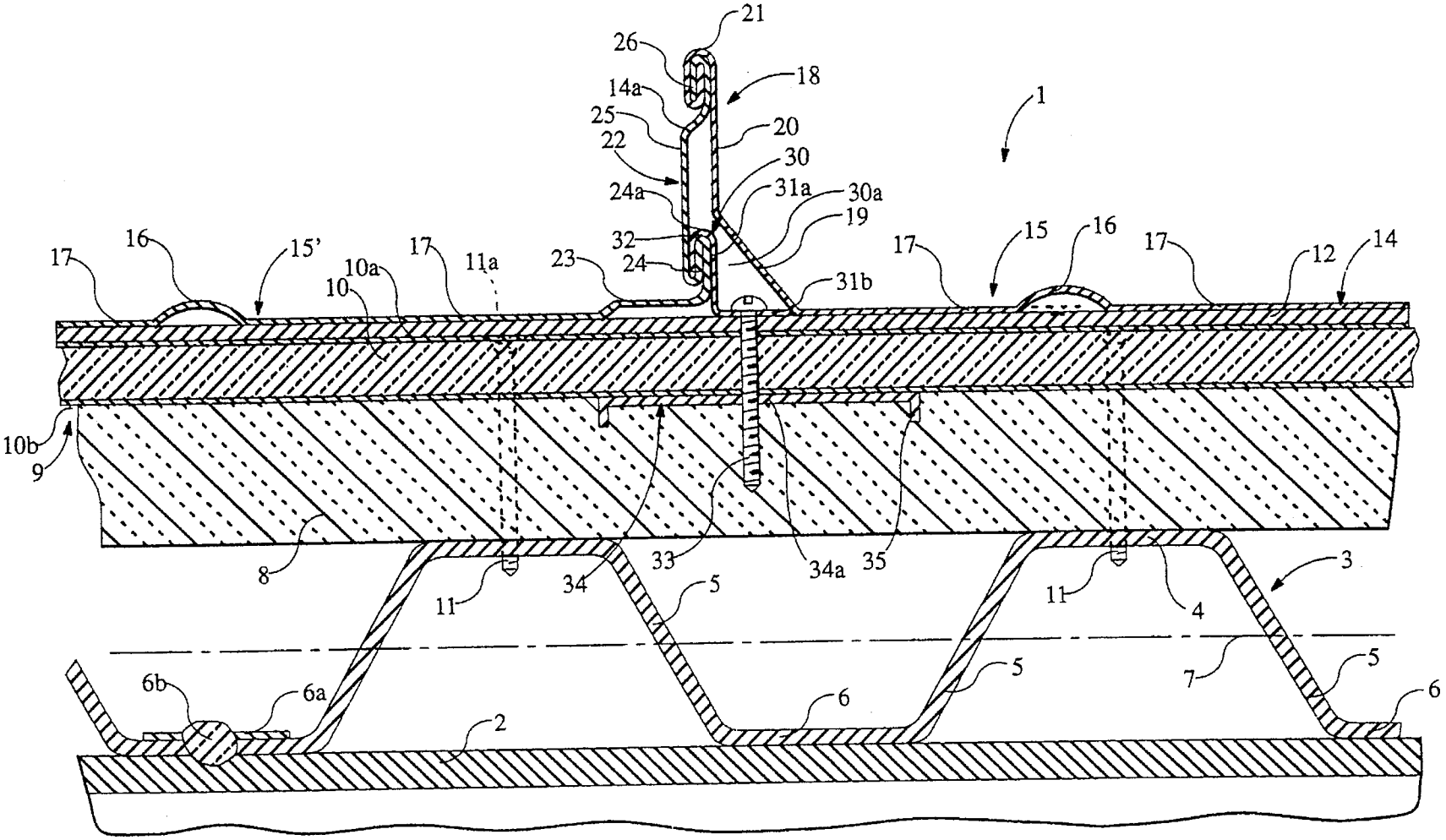
FIG. 1 is a cross-sectional view of the roof assembly in accordance with the present invention.
Figure 2:
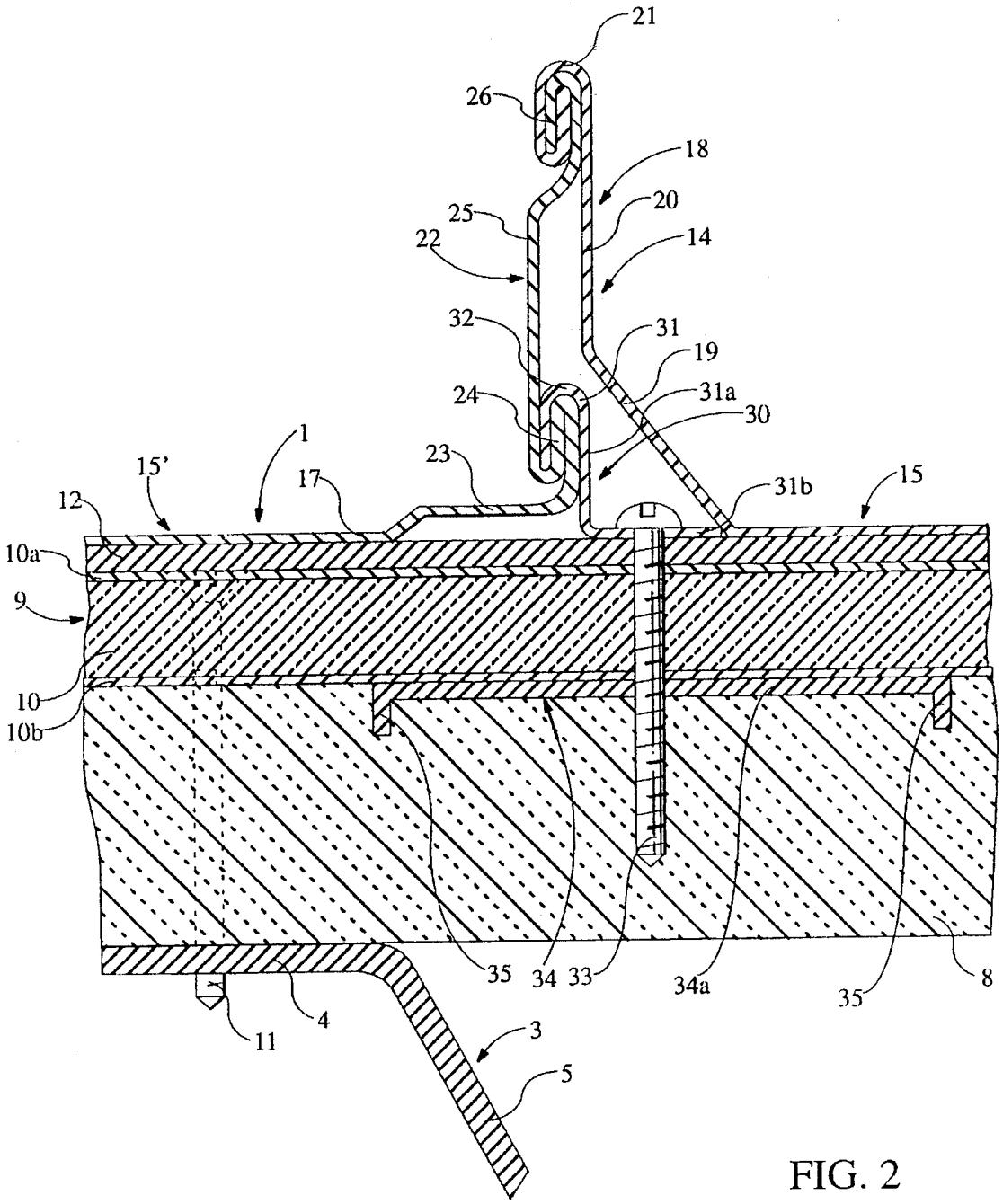
FIG. 2 is a fragmentary enlarged view of a portion of the structure illustrated in FIG. 1.

Referring to FIG. 1 of the drawing, the numeral 1 generally designates a composite roof assembly. Composite roof assembly 1 comprises a sheet 3 of corrugated material anchored to roof beams 2 by attachment means such as a weld washer **6*a* and a plug weld 6*b*, or the like. A sheet of rigid mineral board 9 is secured to the corrugated sheet 3 by threaded fasteners 11 and an external roofing material or layer 14 is superposed over the mineral board 9. Interposed between the corrugated sheet 3 and the mineral board 9 is at least one insulating layer 8**.

As best illustrated in FIG. 1, corrugated sheet 3 includes a plurality of spaced corrugations defining compression ridges 4 and tension ridges 6, with the compression ridges 4 and tension ridges 6 positioned above and below a neutral axis 7. The mineral board 9 is secured to the compression ridges 4 of corrugated sheet 3, thereby restraining the corrugations from lateral distortion when loaded, thus forcing the corrugated section to maintain its shape. Tension ridges of corrugated sheet 3 are secured by welds **6*b* through elongated holes in weld washers 6*a* to and span across space between roof beams 2. The weld washer 6*a*** is of the type disclosed in U.S. Pat. No. 4,601,151. The disclosure of U.S. Pat. No. 4,601,151 is incorporated herein by reference in its entirety for all purposes.

Corrugated sheet 3 preferably has flat compression ridges 4 and flat tension ridges 6 of substantially equal length joined by connector portions 5. As best illustrated in FIG. 1, this configuration has substantially equal distribution of surface area of the corrugated sheet 3 above and below the neutral axis 7. However, a corrugated sheet having an asymmetrical pattern may be employed as the supporting member for the mineral board and external roofing layer 14.

Mineral board 9 generally comprises a substantially rigid core 10 of gypsum faced by upper and lower sheet layers 10*a* and 10*b* of paper or fiberglass meshing of the type disclosed in U.S. Pat. No. 4,647,496, the disclosure of which is incorporated herein by reference for all purposes. Threaded fasteners 11 extend through core 10 and sheets 10*a* and 10*b* and are anchored in the compression ridges 4 of corrugated sheet 3. It will be appreciated that threaded fasteners 11 secure mineral board 9 relative to upper ridges 4 of corrugated sheet 3 but do not extend into roof beams 2. It should be noted that threaded fasteners 11 have enlarged heads 11*a* which engage sheet 10*a*.

In accordance with the present invention, an asphalt saturated felt or self adhering modified bituminous sheet of underlayment 12 is provided on the upper layer 10*a* of the mineral board 9 and under external roofing material 14 to create a moisture barrier. As will be hereinafter more fully explained, moisture barrier 12 is penetrated only by the external roofing material fasteners 33 and remains an effective barrier against moisture despite the penetrations because of the external roofing material 14 configuration and its method of attachment.

In the embodiment of the invention illustrated in the drawings, a standing seam roof is provided as the external roofing material 14 which includes a standing seam 14*a* between metal roofing panels 15 and 15' of the roof assembly 1. The standing seam metal roofing panels 15 and 15' and clips 30 are commercially available from numerous sources. The standing seam roof 14 comprises a plurality of panels 15 and 15' and clips 30. Each panel 15 and 15' comprises a plurality of generally planar areas 17 and a plurality of spaced ribs 16 between the generally planar areas 17, with ribs 16 extending longitudinally of panels 15. Ribs 16 are provided to increase the stiffness of the generally planar areas 17 of panel 15 and for the aesthetic appearance of the standing seam roof 14.

Each panel 15 also includes a female seam portion 18 on one edge of the panel 15 and a male seam portion 22 on the other edge of panel 15, both seams 18 and 22 extending longitudinally of panel 15. The female seam portion comprises an offset portion 19, which provides clearance for dip 30, and a vertically extending seam back 20 having an inverted J-shaped portion 21. The male seam portion 22 comprises an offset base portion 23 which extends up to a Y-shaped seat 24 having a rim 24*a*, and a vertically extending locking seam 25 extending from the seat 24 with a folding ear 26. Female seam 18 abuts male seam 22 so that the inverted J-shaped portion 21 overlays and captures folding ear 26. Once positioned adjacent male seam 22, the inverted J-shaped portion 21 of female seam 18 is folded over ear 26 to cause ear 26 to fold into an inverted U-shaped portion at the distal end of vertically extending seam back 20. When inverted J-shaped portion 21 and ear 26 are folded, a flush seam is formed between adjacent panels 15 and 15'.

Clip 30 comprises an angle 31 with a rim 32 formed at the distal end of angle leg 31*a*. Rim 32 engages Y-shaped seat 24 of male seam 22 to secure the male seam 22. Angle leg 31*b* is anchored relative to upper surface 10*a* of mineral board 9 through moisture barrier layer 12 by threaded fasteners 33, thereby anchoring one end of panel 15' and one end of panel 15 through the mineral board 9 to a retention device 34.

Mineral board 9 is not generally regarded as a structural component and, as such, has a low punching shear capacity. However, included in the design of a roof is consideration of roof uplift forces. In order to anchor standing seam roof 14 to the mineral board 9 by clip 30, a fastener retention device 34 is provided which has a large bearing surface area to distribute the uplift forces seen by the threaded fastener 33 to a large surface area of the mineral board 9. A typical range of widths for retention device 34 is from approximately 3" wide to approximately 4" wide and is aligned so that fastener retention device 34 is spaced apart from threaded fasteners 11, as illustrated in FIG. 1 of the drawing. The length of the strip 34 varies from 10 feet to 12 feet, depending on the application and mineral board lay-out.

By anchoring the standing seam roof 14 through the mineral board 9 to fastener retention device 34 rather than to the corrugated sheet 3, the thermal shorts that would be created by the longer fasteners to the corrugated sheet 3 are eliminated and instead a vertically oriented staggered anchoring system is provided. In addition, the thicker the insulation layers 8 the longer the threaded fasteners. Insulation layer 8 typically varies in thickness from about ¾" to approximately 5 ½. The longer the threaded fasteners the greater the rotation and bending problems in the fastener mechanisms. By reducing the length of the threaded fasteners, thermal shorts are eliminated and the bending and rotation problems associated with extended length fasteners are reduced or even eliminated.

Retention device 34 preferably comprises a strip of light gauge metal having a 22 minimum gauge. To ease installation and reduce shifting, retention device preferably has a channel cross-section with a web 34*a* and downwardly extending flanges 35 which extend into insulation layer 8. An alternative to the channel shaped cross-section is to provide a coating of adhesive to the back side of retention strip 34 which will also ease installation by reducing shifting. It should be readily apparent that other shapes and materials can be used for the retention device to achieve the same effect.

Having described the invention, it is claimed:

1. A deck assembly comprising:

(a) a corrugated sheet of material, said corrugated sheet having a plurality of spaced ridges alternating above a neutral axis forming compression ridges and below the neutral axis forming tension ridges, said spaced ridges extending longitudinally of said corrugated sheet;

(b) a rigid sheet having a front face and a back face;

(c) first fastener means to secure said rigid sheet to said compression ridges of said corrugated sheet;

(d) an exterior roofing material overlaying said rigid sheet and said first fastener means;

(e) elongated fastener retention devices spaced apart from said first fastener means;

(f) second fastener means to secure said exterior roofing material to said rigid sheet, said second fastener means extending through said rigid sheet and engaging said fastener retention devices, said fastener retention devices being channel members having a web and a pair of flanges and being positioned on the back face of said rigid sheet; and (g) a moisture barrier interposed between said exterior roofing material and said rigid sheet and overlaying said first fastener means, said moisture barrier in combination with said spaced apart fastener retention devices forming a staggered anchorage system which eliminates thermal shorts between said first fastener means and said exterior roofing material.

2. A deck assembly according to claim 1 further comprising a layer of insulation interposed between said rigid sheet and said corrugated sheet.

3. A deck assembly according to claim 1 wherein said fastener retention devices comprise strip of rigid material having a width varying from approximately 3 inches to 4 inches.

4. A deck assembly according to claim 3 wherein said strips of rigid material is metal.

5. A roof deck assembly comprising:

(a) spaced horizontally disposed roof beams;

(b) a corrugated sheet of material, said corrugated sheet having a plurality of spaced ribs alternating above the neutral axis forming compression ribs and below the neutral axis forming tension ribs, said spaced ribs extending longitudinally of said corrugated sheet and said corrugated sheet being supported on said roof beams;

(c) a layer of insulation superposed over said corrugated sheet;

(d) a sheet of mineral board overlaying said layer of insulation, said mineral board having a top surface and a back surface, said back surface extending toward said layer of insulation;

(e) a means to secure said mineral board to said compression ribs, said means having a longitudinal extent extending through said layer of insulation and capturing said insulation layer between said mineral board and said corrugated sheet;

(f) an exterior roofing layer overlaying said mineral board;

(g) a means to anchor said exterior roofing layer to said mineral board, said means to anchor including a fastener retention device spaced apart from said means to secure said mineral board to said compression ribs in a direction generally orthogonal to said longitudinal extent; and (h) a moisture barrier layer interposed between said exterior roofing layer and said mineral board, said moisture barrier layer in combination with said fastener retention device forming a staggered anchorage system which eliminates thermal shorts between said means to secure said mineral board to said compression ribs and said exterior roofing layer.

6. A deck assembly according to claim 5 wherein said means to anchor said exterior roofing layer to said mineral board includes a threaded fastener extending through said mineral board and engaging said fastener retention device, said fastener retention device being positioned on the back surface of said mineral board for anchoring the threaded fastener.

7. A deck assembly according to claim 6 wherein said fastener retention device includes a bearing surface, said bearing surface facing the back surface of said mineral board.

8. A deck assembly according to claim 7 wherein said fastener retention device comprises a strip of rigid material having a generally rectangular shape with a width varying from approximately 3 to 4 inches.

9. A deck assembly according to claim 8 wherein said strip of rigid material is metal.

10. A deck assembly according to claim 9 wherein said fastener retention device comprises an elongated channel member having a web and a pair of flanges, wherein said threaded fastener anchors to said web.

11. An insulated standing seam roof deck assembly comprising:

a corrugated sheet of material, said corrugated sheet having a plurality of spaced ridges alternately above a normal axis forming compression ridges and below the neutral axis forming tension ridges, said spaced ridges extending longitudinally of said corrugated sheet;

a layer of insulation material having upper and lower surfaces overlaying said corrugated sheet;

a rigid sheet having a front face and a back face, said back face being positioned adjacent said upper surface of said layer of insulation material;

an elongated fastener retention strip positioned between said back surface of said rigid sheet and said top surface of said layer of insulation material;

a plurality of first threaded fasteners extending through said rigid sheet and said layer of insulation material, said plurality of first threaded fasteners being spaced from said elongated fastener retention strip and having ends anchored in said compression ridges on said corrugated sheet;

an elongated clip having an angle leg positioned above said front face of said rigid sheet;

a plurality of second threaded fasteners extending through said angle leg and said sheet of rigid material, said plurality of second fasteners being anchored in said elongated fastener retention strip; and a plurality of sheets of standing seam metal roof panels, each of said panels having spaced edges with a female seam portion extending along a first edge and a male seam portion extending along a second edge, said male seam portion of a first panel being secured to said clip and said female seam portion of a second panel being secured to said male seam portion of said first panel.

12. A roof deck assembly comprising:

(a) a deck;

(b) a rigid sheet having a front face and a back face, said back face facing said deck;

(c) first fastener means extending through said rigid sheet and securing said rigid sheet to said deck;

(d) an exterior roofing material overlaying said rigid sheet and said first fastener means;

(e) elongated fastener retention devices spaced apart from said first fastener means and positioned on the back face of said rigid sheet;

(f) second fastener means securing said exterior roofing material to said rigid sheet, said second fastener means extending through said rigid sheet and engaging said fastener retention devices; and (g) a moisture barrier interposed between said exterior roofing material and said rigid sheet overlaying said first fastener means, wherein said moisture barrier in combination with said spaced apart fastener retention devices form a staggered anchorage system which eliminates thermal shorts between said first fastener means and said exterior roofing material.

13. A roof deck assembly according to claim 12 wherein said elongated fastener retention devices comprise sheet metal strips.

14. A roof deck assembly according to claim 12 wherein said elongated fastener retention devices comprise channel-shaped fastener retention strips.

15. A roof deck assembly according to claim 12 wherein said elongated fastener retention devices comprise strips of rigid material having bearing surfaces and include adhesive means applied to said bearing surfaces for securing said bearing surfaces against said back face of said rigid sheet during installation.

* * * * *

UNITED STATES PATENT AND TRADEMARK OFFICE

CERTIFICATE OF CORRECTION

PATENT NO. : 5,584,153

DATED : December 17, 1996

INVENTOR(S) : C. Lynn Nunley & Joe W. Tomaselli

It is certified that error appears in the above-indentified patent and that said Letters Patent is hereby corrected as shown below:

Column 3, line 46, change "dip" to read --clip--.

Column 5, line 5, change "strip" to read --strips--.

Column 5, line 60, change "according to claim 9" to read --according to claim 6--.

Signed and Sealed this

Twenty-seventh Day of May, 1997

*Attest:*

Bruce Lehman

BRUCE LEHMAN

*Attesting Officer*

*Commissioner of Patents and Trademarks*